US007918272B2

(12) United States Patent
Gaudette et al.

(10) Patent No.: US 7,918,272 B2
(45) Date of Patent: Apr. 5, 2011

(54) PERMEABLE MEDIUM FLOW CONTROL DEVICES FOR USE IN HYDROCARBON PRODUCTION

(75) Inventors: Sean L. Gaudette, Katy, TX (US); Michael H. Johnson, Katy, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 11/875,584

(22) Filed: Oct. 19, 2007

(65) Prior Publication Data

US 2009/0101342 A1 Apr. 23, 2009

(51) Int. Cl.
*E21B 43/08* (2006.01)

(52) U.S. Cl. ..... 166/205; 166/229

(58) Field of Classification Search ..... 166/229, 166/296, 278, 373, 376, 205, 317
See application file for complete search history.

(56) References Cited

U.S. PATENT DOCUMENTS 1,362,552 A 12/1920 Alexander et al.
1,649,524 A 11/1927 Hammond
1,915,867 A 6/1933 Penick
1,984,741 A 12/1934 Harrington
2,089,477 A 8/1937 Halbert
2,119,563 A * 6/1938 Wells ..... 166/278
2,214,064 A 9/1940 Niles
2,257,523 A 9/1941 Combs
2,412,841 A 12/1946 Spangler
2,762,437 A 9/1956 Egan et al.
2,810,352 A 10/1957 Tumilson
2,814,947 A 12/1957 Stegemeier et al.
2,942,668 A 6/1960 Maly et al.
2,945,541 A 7/1960 Maly et al.
(Continued)

FOREIGN PATENT DOCUMENTS

CN 1385594 12/2002
(Continued)

OTHER PUBLICATIONS

Optimization of Commingled Production Using Infinitely Variable Inflow Control Valves; M.M, J. J. Naus, Delft University of Technology (DUT), Shell International Exploration and production (SIEP); J.D. Jansen, DUT and SIEP; SPE Annual Technical Conference and Exhibition, Sep. 26-29, Houston, Texas, 2004, Society of Patent Engineers.

(Continued)

*Primary Examiner* — Daniel P Stephenson
(74) *Attorney, Agent, or Firm* — Mossman, Kumar & Tyler, PC

(57) ABSTRACT

An in-flow control device controls fluid flow into a wellbore tubular using a permeable medium positioned in a flow space. The permeable medium induces a predetermined pressure differential in the flow space. The permeable medium may include separate elements having interstitial spaces and/or solid porous members. In arrangements, a filtration element may be positioned upstream of the flow space. In arrangements, the flow space may be formed in a plug member associated with the housing. In certain embodiments, a flow restriction element, such as a check valve, in the housing may provide parallel fluid communication with the bore of the wellbore tubular. Additionally, an occlusion body may be positioned in the flow space and configured to disintegrate upon exposure to a preset condition. The occlusion body temporarily seals the flow space so that a bore of the tubular may be pressurized.

20 Claims, 5 Drawing Sheets

U.S. PATENT DOCUMENTS 3,326,291 A * 6/1967 Zandmer ..... 166/100
3,385,367 A 5/1968 Kollsman
3,419,089 A * 12/1968 Venghiattis ..... 175/4.57
3,451,477 A 6/1969 Kelley
3,675,714 A 7/1972 Thompson
3,692,064 A 9/1972 Hohnerlein et al.
3,739,845 A 6/1973 Berry et al.
3,791,444 A 2/1974 Hickey
3,876,471 A 4/1975 Jones
3,918,523 A 11/1975 Stuber
3,951,338 A 4/1976 Genna
3,975,651 A 8/1976 Griffiths
4,153,757 A 5/1979 Clark, III
4,173,255 A 11/1979 Kramer
4,180,132 A 12/1979 Young
4,186,100 A 1/1980 Mott
4,187,909 A 2/1980 Erbstoesser
4,248,302 A 2/1981 Churchman
4,250,907 A 2/1981 Struckman et al.
4,257,650 A 3/1981 Allen
4,287,952 A 9/1981 Erbstoesser
4,415,205 A 11/1983 Rehm et al.
4,434,849 A 3/1984 Allen
4,491,186 A 1/1985 Alder
4,497,714 A 2/1985 Harris
4,552,218 A 11/1985 Ross et al.
4,572,295 A 2/1986 Walley
4,614,303 A 9/1986 Moseley, Jr. et al.
4,649,996 A * 3/1987 Kojicic et al. ..... 166/228
4,821,800 A 4/1989 Scott et al.
4,856,590 A 8/1989 Caillier
4,917,183 A 4/1990 Gaidry et al.
4,944,349 A 7/1990 Von Gonten, Jr.
4,974,674 A 12/1990 Wells
4,998,585 A 3/1991 Newcomer et al.
5,004,049 A 4/1991 Arterbury
5,016,710 A 5/1991 Renard et al.
5,132,903 A 7/1992 Sinclair
5,156,811 A 10/1992 White
5,333,684 A 8/1994 Walter et al.
5,337,821 A 8/1994 Peterson
5,339,895 A 8/1994 Arterbury et al.
5,377,750 A 1/1995 Arterbury et al.
5,381,864 A 1/1995 Nguyen et al.
5,431,346 A 7/1995 Sinaisky
5,435,393 A 7/1995 Brekke et al.
5,435,395 A 7/1995 Connell
5,439,966 A 8/1995 Graham et al.
5,551,513 A 9/1996 Surles et al.
5,586,213 A 12/1996 Bridges et al.
5,597,042 A 1/1997 Tubel et al.
5,609,204 A 3/1997 Rebardi et al.
5,673,751 A 10/1997 Head et al.
5,803,179 A 9/1998 Echols
5,831,156 A 11/1998 Mullins
5,839,508 A 11/1998 Tubel et al.
5,873,410 A 2/1999 Iato et al.
5,881,809 A 3/1999 Gillespie et al.
5,896,928 A 4/1999 Coon
5,982,801 A 11/1999 Deak
6,068,015 A 5/2000 Pringle
6,098,020 A 8/2000 Den Boer
6,112,815 A 9/2000 Boe et al.
6,112,817 A 9/2000 Voll
6,119,780 A 9/2000 Christmas
6,228,812 B1 5/2001 Dawson et al.
6,253,847 B1 7/2001 Stephenson
6,253,861 B1 7/2001 Carmichael et al.
6,273,194 B1 8/2001 Hiron
6,305,470 B1 10/2001 Woie
6,338,363 B1 1/2002 Chen et al.
6,367,547 B1 4/2002 Towers et al.
6,371,210 B1 4/2002 Bode et al.
6,372,678 B1 4/2002 Youngman et al.
6,419,021 B1 7/2002 George et al.
6,474,413 B1 11/2002 Barbosa et al.
6,505,682 B2 1/2003 Brockman
6,516,888 B1 2/2003 Gunnerson et al.
6,581,681 B1 6/2003 Zimmerman et al.
6,581,682 B1 6/2003 Parent et al.
6,622,794 B2 9/2003 Zisk
6,632,527 B1 10/2003 McDaniel et al.
6,635,732 B2 10/2003 Mentak
6,667,029 B2 12/2003 Zhong et al.
6,679,324 B2 1/2004 Boer et al.
6,692,766 B1 2/2004 Rubinstein et al.
6,699,503 B1 3/2004 Sako et al.
6,699,611 B2 3/2004 Kim et al.
6,786,285 B2 9/2004 Johnson et al.
6,817,416 B2 11/2004 Wilson et al.
6,840,321 B2 1/2005 Restarick et al.
6,857,476 B2 2/2005 Richards
6,863,126 B2 3/2005 McGlothen et al.
6,938,698 B2 9/2005 Coronado
6,951,252 B2 10/2005 Restarick et al.
6,976,542 B2 12/2005 Henriksen et al.
7,011,076 B1 3/2006 Weldon et al.
7,084,094 B2 8/2006 Gunn et al.
7,159,656 B2 1/2007 Eoff et al.
7,185,706 B2 3/2007 Freyer
7,290,606 B2 11/2007 Coronado et al.
7,318,472 B2 1/2008 Smith
7,322,412 B2 1/2008 Badalamenti et al.
7,325,616 B2 2/2008 Lopez de Cardenas et al.
7,395,858 B2 7/2008 Barbosa et al.
7,409,999 B2 8/2008 Henriksen et al.
7,469,743 B2 12/2008 Richards
7,673,678 B2 3/2010 MacDougall et al.
2002/0020527 A1 2/2002 Kilaas
2002/0125009 A1 9/2002 Wetzel et al.
2003/0221834 A1 12/2003 Hess et al.
2004/0052689 A1 3/2004 Yao
2004/0144544 A1 7/2004 Freyer
2004/0194971 A1 10/2004 Thomson
2005/0016732 A1 1/2005 Brannon et al.
2005/0126776 A1* 6/2005 Russell ..... 166/229
2005/0171248 A1 8/2005 Li et al.
2005/0178705 A1 8/2005 Broyles et al.
2005/0189119 A1 9/2005 Gynz-Rekowski
2005/0199298 A1 9/2005 Farrington
2005/0207279 A1 9/2005 Chemali et al.
2005/0241835 A1 11/2005 Burris et al.
2006/0042798 A1 3/2006 Badalamenti et al.
2006/0048936 A1 3/2006 Fripp et al.
2006/0048942 A1* 3/2006 Moen et al. ..... 166/306
2006/0076150 A1 4/2006 Coronado
2006/0086498 A1 4/2006 Wetzel et al.
2006/0108114 A1* 5/2006 Johnson ..... 166/276
2006/0175065 A1 8/2006 Ross
2006/0185849 A1 8/2006 Edwards et al.
2006/0272814 A1 12/2006 Broome et al.
2006/0273876 A1 12/2006 Pachla et al.
2007/0012444 A1 1/2007 Horgan et al.
2007/0039741 A1* 2/2007 Hailey, Jr. ..... 166/376
2007/0044962 A1 3/2007 Tibbles
2007/0131434 A1 6/2007 MacDougall et al.
2007/0246210 A1 10/2007 Richards
2007/0246213 A1 10/2007 Hailey, Jr.
2007/0246225 A1 10/2007 Hailey, Jr. et al.
2007/0246407 A1 10/2007 Richards et al.
2007/0272408 A1 11/2007 Zazovsky et al.
2008/0035349 A1 2/2008 Richard
2008/0035350 A1 2/2008 Henriksen et al.
2008/0053662 A1 3/2008 Williamson et al.
2008/0135249 A1* 6/2008 Fripp et al. ..... 166/285
2008/0149323 A1 6/2008 O'Malley et al.
2008/0149351 A1 6/2008 Marya et al.
2008/0236839 A1 10/2008 Oddie
2008/0236843 A1 10/2008 Scott et al.
2008/0283238 A1 11/2008 Richards et al.
2008/0296023 A1 12/2008 Willauer
2008/0314590 A1 12/2008 Patel
2009/0056816 A1 3/2009 Arov et al.
2009/0133869 A1 5/2009 Clem
2009/0133874 A1 5/2009 Dale et al.
2009/0139727 A1 6/2009 Tanju et al.
2009/0205834 A1 8/2009 Garcia et al.

FOREIGN PATENT DOCUMENTS

| | | | |
|---|---|---|---|
| GB | 1492345 | | 11/1977 |
| GB | 2341405 | | 12/2007 |
| WO | 9403743 | A1 | 2/1994 |
| WO | WO 00/79097 | | 5/2000 |
| WO | WO 01/65063 | | 2/2001 |
| WO | WO 01/77485 | | 3/2001 |
| WO | WO 02/075110 | | 9/2002 |
| WO | 2004018833 | A1 | 3/2004 |
| WO | WO 2006/015277 | | 2/2006 |

OTHER PUBLICATIONS

An Oil Selective Inflow Control System; Rune Freyer, Easy Well Solutions; Morten Fejerskkov, Norsk Hydro; Arve Huse, Altinex; European Petroleum Conference, Oct. 29-31, Aberdeen, United Kingdom, Copyright 2002, Society of Petroleum Engineers, Inc.

Determination of Perforation Schemes to Control Production and Injection Profiles Along Horizontal; Asheim, Harald, Norwegian Institute of Technology; Oudeman, Pier, Koninklijke/Shell Exploratie en Producktie Laboratorium; SPE Drilling & Completion, vol. 12, No. 1, March; pp. 13-18; 1997 Society of Petroleum Engineers.

Dikken, Ben J., SPE, Koninklijke/Shell E&P Laboratorium; "Pressure Drop In Horizontal Wells and Its Effect on Production Performance"; Nov. 1990, JPT; Copyright 1990, Society of Petroleum Engineers; pp. 1426-1433.

Restarick, Henry, SPE, Halliburton Energy Services; "SPE 29831, Horizontal Completion Options in Reservior With Sand Problems"; Presented at the SPE Middle East Oil Show, Bahrain, Mar. 11-14, 1985; Copyright 1995, Society of Petroleum Engineers; pp. 545-559.

"Rapid Swelling and Deswelling of Thermoreversible Hydrophobically Modified Poly(N-Isopropylacrylamide) Hydrogels Prepared by Freezing Polymerisation", Xue, W., Hamley, I. W. and Huglin, M. B., 2002, 43(1) 5181-5186.

"Thermoreversible Swelling Behavior of Hydrogels Based on N-Isopropylacrylamide with a Zwitterionic Comonomer", Xue, W., Champ, S. amd Huglin, M. B. 2001, European Polymer Journal, 37(5) 869-875.

Dinarvand, R., D'Emanuele, A (1995) The use of thermoresponsive hydrogels for on-off release of molecules, J. Control, Rel. 36 221-227.

Tanaka, T., Nishio, I., Sun, S.T., Ueno-Nisho, S. (1982) Collapse of gels in an electric field. Science. 218:467-469.

Ishihara.K., Harnada, N., Sato, S., Shinohara, I., (1984) Photoinduced serlling control of amphiphdllic azoaromatic polymer membrane. J. Polym. Sci., Polym. Chem. Ed. 22: 121-128.

Ricka, J. Tanaka, T. (1984) Swelling of Ionic gels: Quantitative performance of the Donnan Thory, Macromolecules. 17 2916-2921.

Stephen P. Mathis, Baker Oil Tools, SPE; "Sand Management: A Review of Approaches and Concerns; SPE 82240"; Presented at the SPE European Formation Damage Conference, Hague, The Netherlands May 13-14, 2003; Copyright 2003, Society of Petroleum Engineers Inc.

E. Paul Bercegeay, University of Southwestern Louisiana; Charles A. Richard, Baker Oil Tools, Inc., Member AIME; "A One-trip Gravel Packing System, SPE 4771"; Prepared for the Society of Petroleum Engineers of AIME Symposium on Formation Damage Control, New Orleans, La., Feb. 7-8, 1974; Copyright 1974, American Institute of Mining, Metallurgical and Petroleum Engineers, Inc.

* cited by examiner

PERMEABLE MEDIUM FLOW CONTROL DEVICES FOR USE IN HYDROCARBON PRODUCTION

BACKGROUND OF THE DISCLOSURE

1. Field of the Disclosure

The disclosure relates generally to systems and methods for selective control of fluid flow into a production string in a wellbore.

2. Description of the Related Art

Hydrocarbons such as oil and gas are recovered from a subterranean formation using a wellbore drilled into the formation. Such wells are typically completed by placing a casing along the wellbore length and perforating the casing adjacent each such production zone to extract the formation fluids (such as hydrocarbons) into the wellbore. These production zones are sometimes separated from each other by installing a packer between the production zones. Fluid from each production zone entering the wellbore is drawn into a tubing that runs to the surface. It is desirable to have substantially even drainage along the production zone. Uneven drainage may result in undesirable conditions such as an invasive gas cone or water cone. In the instance of an oil-producing well, for example, a gas cone may cause an in-flow of gas into the wellbore that could significantly reduce oil production. In like fashion, a water cone may cause an in-flow of water into the oil production flow that reduces the amount and quality of the produced oil. Accordingly, it is desired to provide even drainage across a production zone and/or the ability to selectively close off or reduce in-flow within production zones experiencing an undesirable influx of water and/or gas.

The present disclosure addresses these and other needs of the prior art.

SUMMARY OF THE DISCLOSURE

In aspects, the present disclosure provides an in-flow control device for controlling a flow of fluid from a formation into a wellbore tubular. In one embodiment, the in-flow control device includes a flow space that provides fluid communication between the formation and a bore of the wellbore tubular. A permeable medium or media may be positioned in the flow space to induce a predetermined pressure differential across the permeable medium or media. For example, the permeable medium may have a porosity configured to provide the desired predetermined pressure differential. In some embodiments, the permeable medium may include a plurality of substantially separate elements having interstitial spaces therebetween when positioned in the flow space. In other embodiments, the permeable medium may include solid porous members. In still other embodiments, a medium in the flow space may include a combination of materials. In one embodiment, the in-flow control device may include a housing positioned along the wellbore tubular. The flow space may be formed in the housing. In some arrangements, a filtration element may be positioned upstream of the flow space of the in-flow control device. In one arrangement, the flow space may be formed in a plug member associated with the housing. In certain applications, the plug member may be removable. In certain embodiments, a flow restriction element in the housing may provide parallel fluid communication with the bore of the wellbore tubular. For instance, a check valve may be configured to open upon a preset pressure being reached in the in-flow control device. Additionally, an occlusion body may be positioned in the flow space and configured to disintegrate upon exposure to a preset condition. The occlusion body temporarily seals the flow space so that a bore of the tubular may be pressurized.

In aspects, the present disclosure provides a system for controlling a flow of a fluid from a formation into a wellbore tubular. The system may include a plurality of in-flow control devices positioned along a section of the wellbore tubular. Each in-flow control device may include a permeable medium positioned in a flow path between the formation and a flow bore of the wellbore tubular to control a flow characteristic. The flow characteristic may be one or more of: (i) pressure, (ii) flow rate, and (iii) fluid composition. In one arrangement, the porosity of each permeable medium is configured to cause a substantially uniform flow characteristic along the section of the wellbore tubular. In certain arrangements, a filtration element may be positioned upstream of one or more of the plurality of in-flow control devices. The permeable medium may include a plurality of substantially separate elements configured to have interstitial spaces therebetween when positioned in the flow space and/or a substantially solid member having pores.

In aspects, the present disclosure provides a method for controlling a flow of fluid from a formation into a wellbore tubular. The method may include providing fluid communication between the formation and a bore of the wellbore tubular via a flow space and positioning a permeable medium in the flow space. The permeable medium may have a porosity configured to induce a predetermined pressure differential across the permeable medium.

It should be understood that examples of the more important features of the disclosure have been summarized rather broadly in order that detailed description thereof that follows may be better understood, and in order that the contributions to the art may be appreciated. There are, of course, additional features of the disclosure that will be described hereinafter and which will form the subject of the claims appended hereto.

BRIEF DESCRIPTION OF THE DRAWINGS

The advantages and further aspects of the disclosure will be readily appreciated by those of ordinary skill in the art as the same becomes better understood by reference to the following detailed description when considered in conjunction with the accompanying drawings in which like reference characters designate like or similar elements throughout the several figures of the drawing and wherein.

DETAILED DESCRIPTION OF THE PREFERRED EMBODIMENTS

Figure 1:
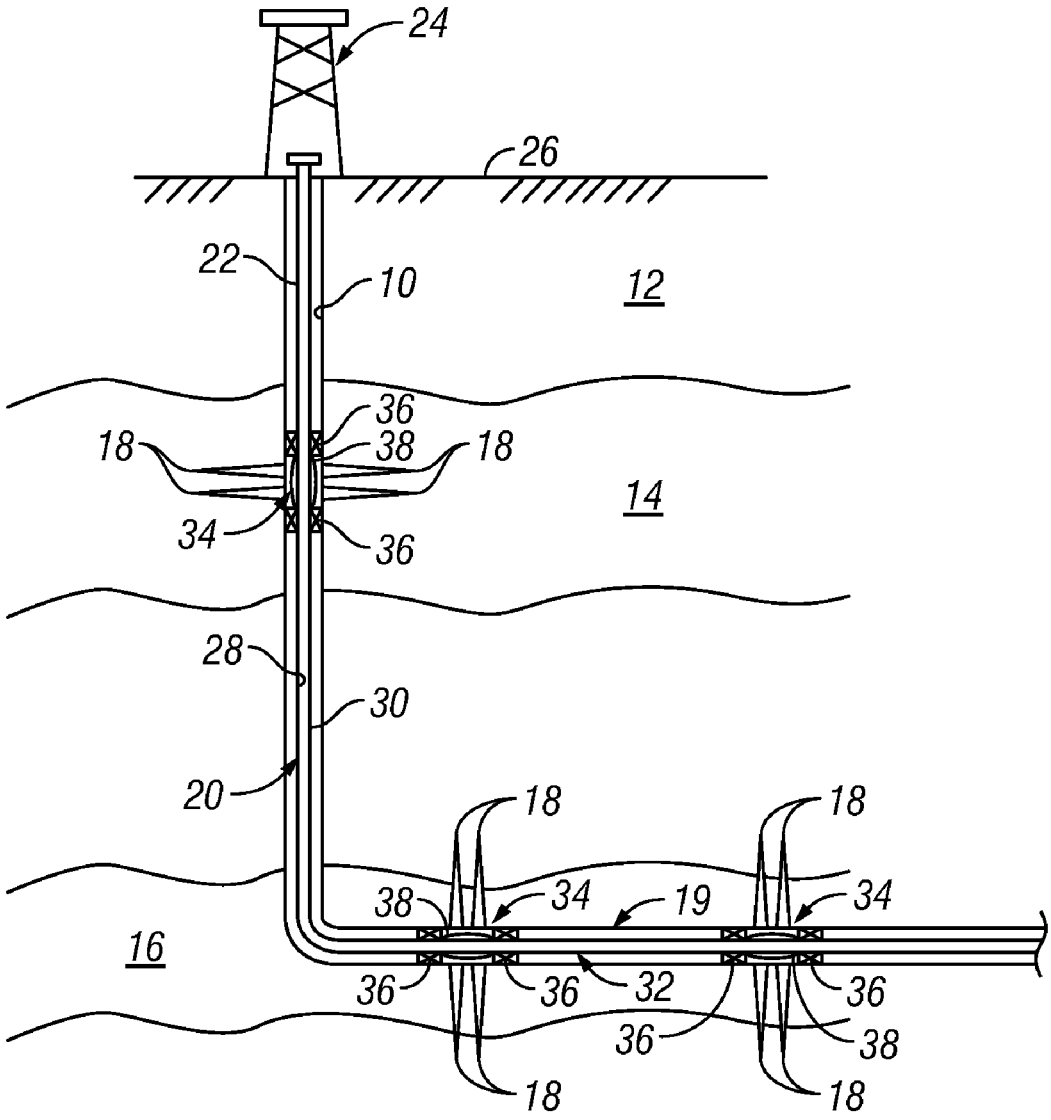
FIG. 1 is a schematic elevation view of an exemplary multi-zonal wellbore and production assembly which incorporates an in-flow control system in accordance with one embodiment of the present disclosure.

The present disclosure relates to devices and methods for controlling production of a hydrocarbon producing well. The present disclosure is susceptible to embodiments of different forms. There are shown in the drawings, and herein will be described in detail, specific embodiments of the present disclosure with the understanding that the present disclosure is to be considered an exemplification of the principles of the disclosure and is not intended to limit the disclosure to that illustrated and described herein. Further, while embodiments may be described as having one or more features or a combination of two or more features, such a feature or a combination of features should not be construed as essential unless expressly stated as essential.

Referring initially to FIG. 1, there is shown an exemplary wellbore 10 that has been drilled through the earth 12 and into a pair of formations 14, 16 from which it is desired to produce hydrocarbons. The wellbore 10 is cased by metal casing, as is known in the art, and a number of perforations 18 penetrate and extend into the formations 14, 16 so that production fluids may flow from the formations 14, 16 into the wellbore 10. The wellbore 10 has a deviated, or substantially horizontal leg 19. The wellbore 10 has a late-stage production assembly, generally indicated at 20, disposed therein by a tubing string 22 that extends downwardly from a wellhead 24 at the surface 26 of the wellbore 10. The production assembly 20 defines an internal axial flowbore 28 along its length. An annulus 30 is defined between the production assembly 20 and the wellbore casing. The production assembly 20 has a deviated, generally horizontal portion 32 that extends along the deviated leg 19 of the wellbore 10. Production devices 34 are positioned at selected points along the production assembly 20. Optionally, each production device 34 is isolated within the wellbore 10 by a pair of packer devices 36. Although only two production devices 34 are shown in FIG. 1, there may, in fact, be a large number of such production devices arranged in serial fashion along the horizontal portion 32.

Each production device 34 features a production control device 38 that is used to govern one or more aspects of a flow of one or more fluids into the production assembly 20. As used herein, the term "fluid" or "fluids" includes liquids, gases, hydrocarbons, multi-phase fluids, mixtures of two of more fluids, water, brine, engineered fluids such as drilling mud, fluids injected from the surface such as water, and naturally occurring fluids such as oil and gas. Additionally, references to water should be construed to also include water-based fluids; e.g., brine or salt water. In accordance with embodiments of the present disclosure, the production control device 38 may have a number of alternative constructions that ensure selective operation and controlled fluid flow therethrough.

Figure 2:
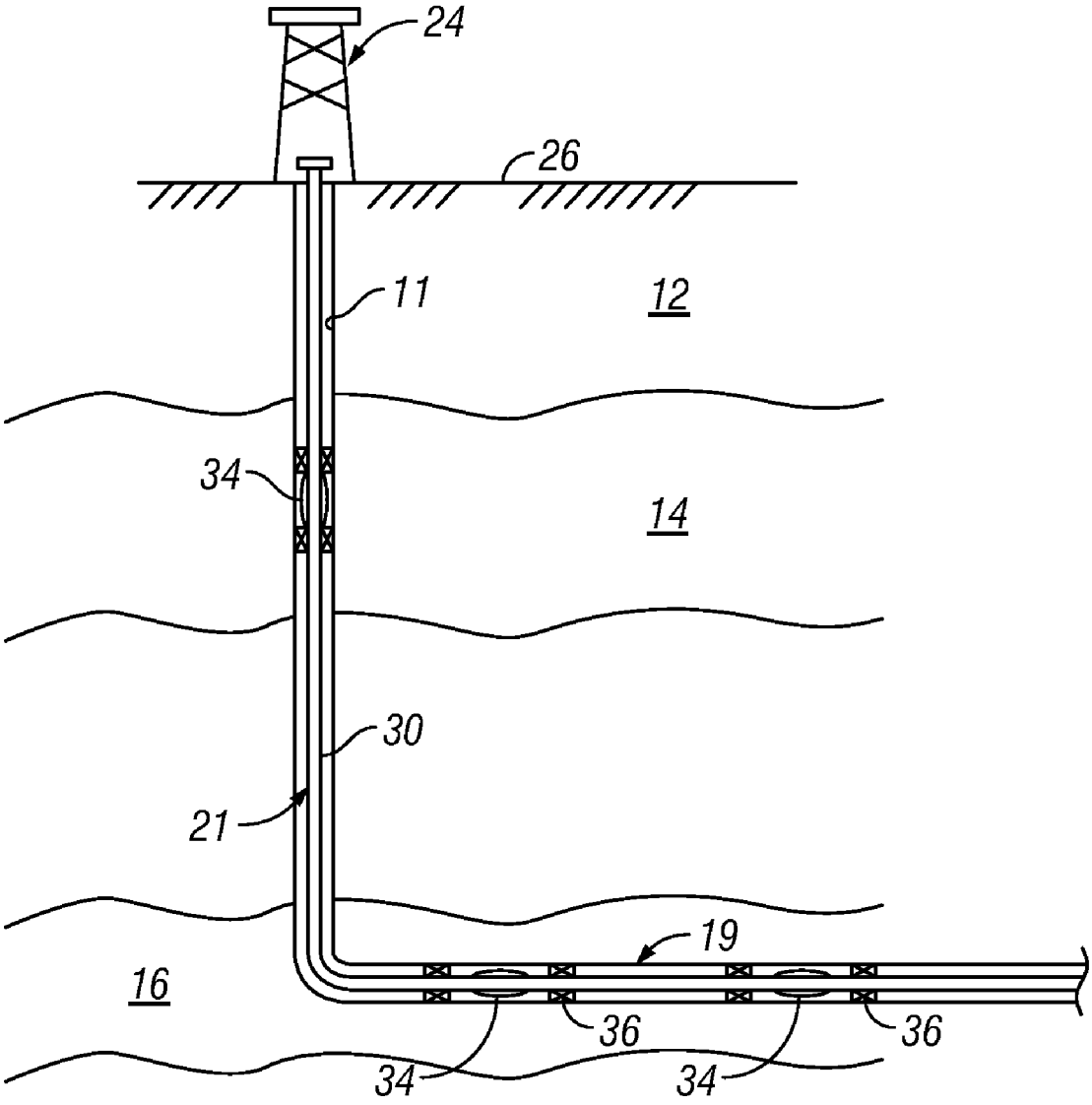
FIG. 2 is a schematic elevation view of an exemplary open hole production assembly which incorporates an in-flow control system in accordance with one embodiment of the present disclosure.

FIG. 2 illustrates an exemplary open hole wellbore arrangement 11 wherein the production devices of the present disclosure may be used. Construction and operation of the open hole wellbore 11 is similar in most respects to the wellbore 10 described previously. However, the wellbore arrangement 11 has an uncased borehole that is directly open to the formations 14, 16. Production fluids, therefore, flow directly from the formations 14, 16, and into the annulus 30 that is defined between the production assembly 21 and the wall of the wellbore 11. There are no perforations, and open hole packers 36 may be used to isolate the production control devices 38. The nature of the production control device is such that the fluid flow is directed from the formation 16 directly to the nearest production device 34, hence resulting in a balanced flow. In some instances, packers maybe omitted from the open hole completion.

Figure 3:
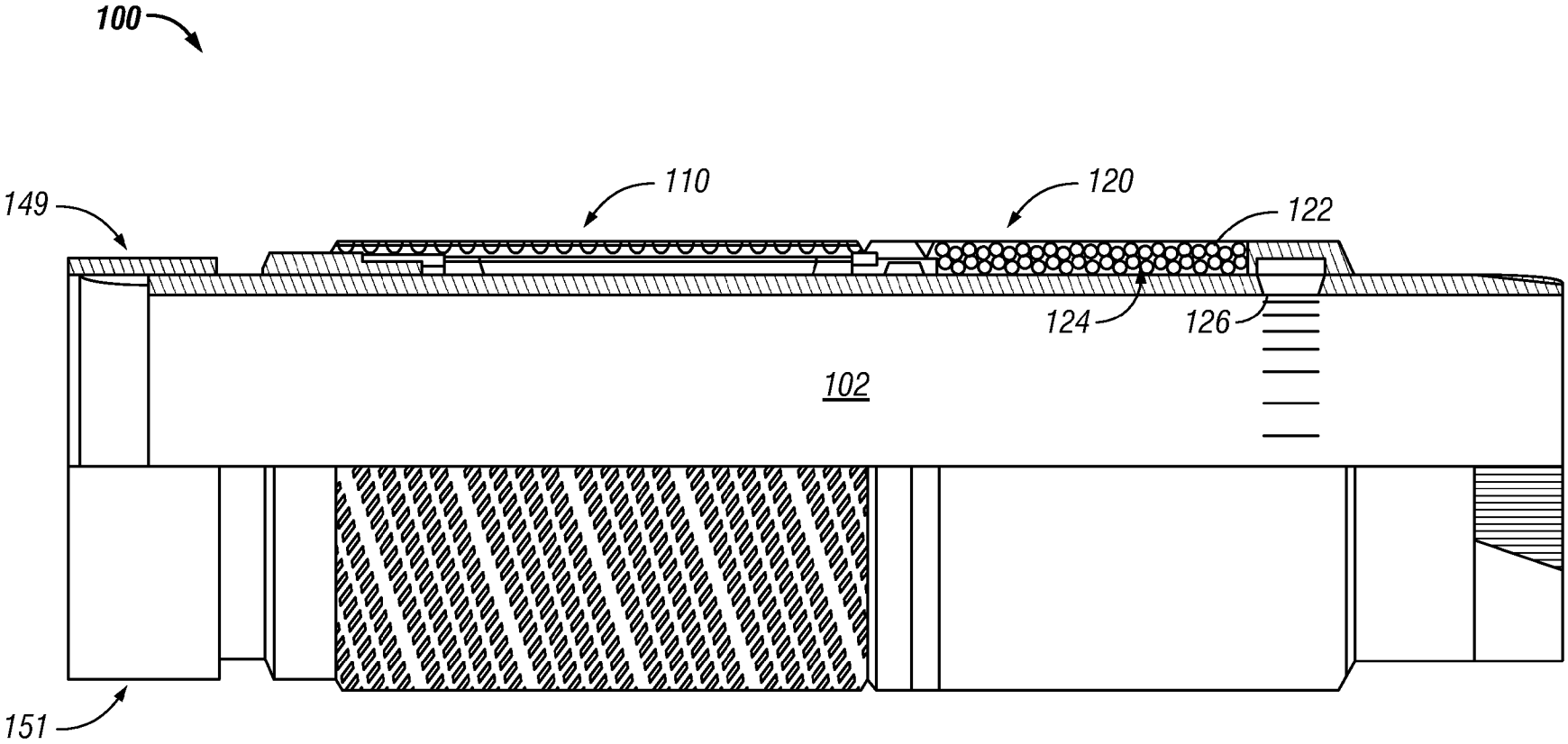
FIG. 3 is a schematic cross-sectional view of an exemplary production control device made in accordance with one embodiment of the present disclosure.

Referring now to FIG. 3, there is shown one embodiment of a production control device 100 for controlling the flow of fluids from a reservoir into a production string. This flow control can be a function of one or more characteristics or parameters of the formation fluid, including water content, fluid velocity, gas content, etc. Furthermore, the control devices 100 can be distributed along a section of a production well to provide fluid control at multiple locations. This can be advantageous, for example, to equalize production flow of oil in situations wherein a greater flow rate is expected at a "heel" of a horizontal well than at the "toe" of the horizontal well. By appropriately configuring the production control devices 100, such as by pressure equalization or by restricting in-flow of gas or water, a well owner can increase the likelihood that an oil bearing reservoir will drain efficiently. Exemplary production control devices are discussed herein below.

In one embodiment, the production control device 100 includes a particulate control device 110 for reducing the amount and size of particulates entrained in the fluids and an in-flow control device 120 that controls overall drainage rate from the formation. The particulate control device 110 can include known devices such as sand screens and associated gravel packs. In embodiments, the in-flow control device 120 utilizes a permeable medium to create a predetermined pressure drop that assists in controlling in-flow rate. Illustrative embodiments are described below.

An exemplary in-flow control device 120 creates a pressure drop for controlling in-flow by channeling the in-flowing fluid through one or more conduits 122 that include a permeable medium 124. The conduits 122 form a flow space that conveys fluid from the exterior of the in-flow control device 120 to openings 126 that direct the fluid into the flow bore 102 of a wellbore tubular, e.g., tubing 22 (FIG. 1). In aspects, Darcy's Law may be used to determine the dimensions and other characteristics of the conduit 122 and the permeable medium 124 that will cause a selected pressure drop. As is known, Darcy's Law is an expression of the proportional relationship between the instantaneous discharge rate through a permeable medium, the viscosity of the fluid, and the pressure drop over a given distance:

$$Q = \frac{-\kappa A}{\mu} \frac{(P_2 - P_1)}{L}$$

where Q is the total discharge, κ is permeability of the permeable medium, A is the cross-sectional flow area, $(P_2-P_1)$ is the pressure drop, μ is the viscosity of the fluid, and L is the length of the conduit. Because permeability, cross-sectional flow area, and the length of the conduit are characteristics of the in-flow control device 120, the in-flow control device 120 may be constructed to provide a specified pressure drop for a given type of fluid and flow rate.

The permeability of the conduit 122 may be controlled by appropriate selection of the structure of the permeable medium 124. Generally speaking, the amount of surface area along the conduit 122, the cross-sectional flow area of the conduit 122, the tortuosity of conduit the 122, among other factors, determine the permeability of the conduit 122. In one embodiment, the permeable medium 124 may be formed using elements that are packed into the conduit 122. The elements may be granular elements such as packed ball bearings, beads, or pellets, or fiberous elements such as "steel wool" or any other such element that form interstetial spaces through which a fluid may flow. The elements may also be capillary tubes arranged to permit flow across the conduit 122. In other embodiments, the permeable medium 124 may include one or more bodies in which pores are formed. For example, the body may be a sponge-like object or a stack of filter-type elements that are perforated. It will be appreciated that appropriate selection of the dimensions of objects such as beads, the number, shape and size of pores or perforations, the diameter and number of capillary tubes, etc., may yield the desired permeability for a selected pressure drop.

Figure 4:
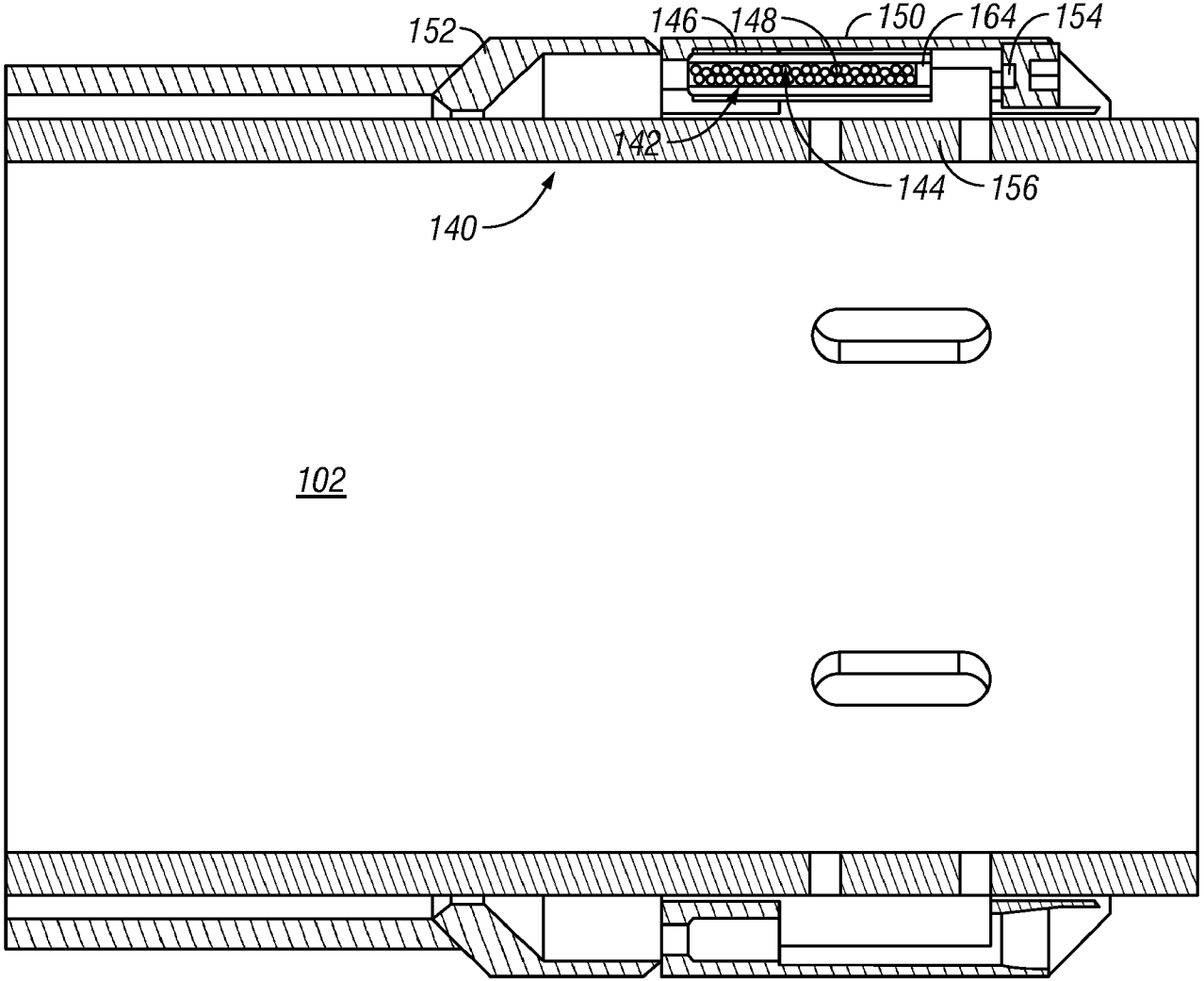
FIG. 4 is schematic cross-sectional view of an exemplary production control device that uses a plug member made in accordance with one embodiment of the present disclosure.
Figure 5:
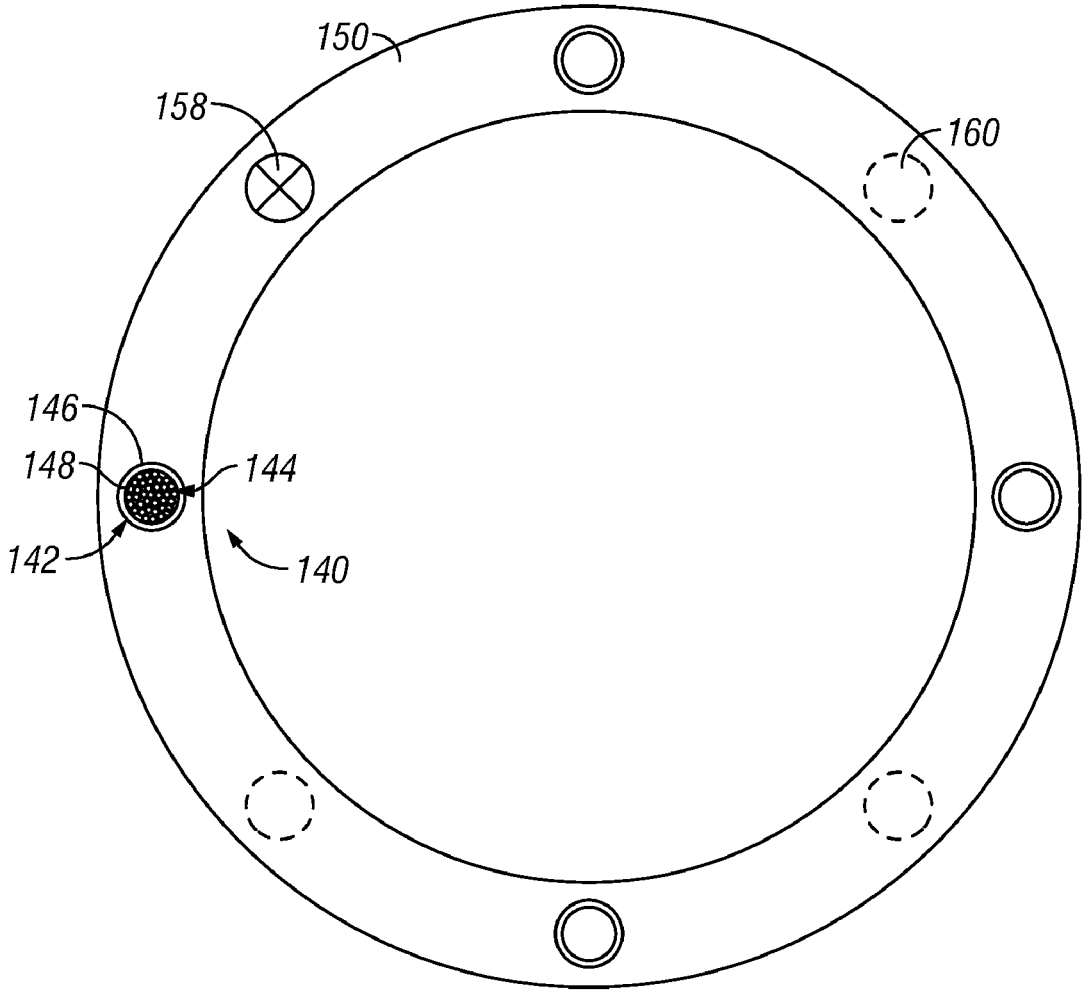
FIG. 5 is schematic end view of the FIG. 4 embodiment.

Referring now to FIGS. 4 and 5, there is shown another embodiment of an in-flow control device 140 that creates a pressure drop by conveying the in-flowing fluid through an array of plug elements, each of which is designated with numeral 142. Each plug element 142 includes a permeable medium 144. The plug element 142 may be formed as a tubular member having a bore 146 filled with elements 148. The plug elements 142 may be positioned in a housing 150 that may be formed as a ring or collar that surrounds the wellbore tubular such as the tubing string 22 (FIG. 1). The depiction of four plug elements 142 is purely arbitrary. Greater or fewer number of plug elements 142 may be used as needed to meet a particular application. The housing 150 may be connected to the particulate control device 110 (FIG. 3) either directly or with an adapter ring 152. Additionally, the housing 150 may include an access port 154 that provides access to the interior of the housing. Orifices 156 provide fluid communication between the in-flow control device 140 and the flow bore 102 of the tubing string 22 (FIG. 1).

Referring now to FIG. 5, in certain embodiments, a flow control element 158 may be used to maintain a predetermined flow condition across the in-flow control device 140. For example, the flow control element 158 may be a check valve, a frangible element, or other device that opens when exposed to a preset pressure differential. In one scenario, the flow control element 158 may be configured to open when a sufficient pressure differential exists across the in-flow control device 140. Such a pressure differential may be associated with a substantial reduction of flow across the plug elements 142 due to clogging of the permeable medium 144. Allowing some controlled fluid in-flow in such situations may be useful to maintain an efficient drainage.

In certain embodiments, an occlusion body 164 may be positioned in the housing 150 to temporarily block fluid flow through the in-flow control device 140. The occlusion body 164 may be formed of a material that ruptures, dissolves, factures, melts or otherwise disintegrates upon the occurrence of a predetermined condition. In some embodiments, the occlusion body 164 may be positioned downstream of the plug member 142 as shown or upstream of the plug member 142. In other embodiments, the occlusion body 164 may be a material that fills the interstitial spaces of the plug member 142. During deployment or installation of the in-flow control device 140 into a well, the occlusion body 164 allows a relatively high pressure differential to exist across the in-flow control device 140. This may be advantageous during installation because a well may require relatively high pressures in order to actuate valves, slips, packers, and other types of hydraulically actuated completion equipment. Once a given completion activity is completed, the occlusion body 164 may disintegrate due to exposure to a fluid, such as oil, or exposure to the wellbore environment (e.g., elevated pressure or temperatures) or exposure to material pumped downhole.

During operation, fluid from the formation flows through the particulate control device 110 and into the in-flow control device 140. As the fluid flows through the permeable medium in the plug members 142, a pressure drop is generated that results in a reduction of the flow velocity of the fluid. Furthermore, as will be discussed in more detail later, the back pressure associated with the in-flow control device assists in maintaining an efficient drainage pattern for the formation.

In some embodiments, an in-flow control device, e.g., the in-flow control device 120 or 140, may be constructed to have a preset pressure drop for a given fluid. In other embodiments, an in-flow control device may be constructed to be tuned or configured "in the field" to provide a selected pressure drop. For example, the housing 150 may be configured to have several receptacles 160 for receiving a plug element 142. Positioning a plug element 142 in each of the available receptacles 160 would maximize the number of flow conduits and provide the lowest pressure drops. To increase the pressure drop, one or more receptacles 160 may be fitted with a "blank" or stopping member to block fluid flow. Thus, in one arrangement, varying the number of plug elements 142 may be used to control the pressure differential generated by the in-flow control device. Another arrangement may include constructing the housing 150 to receive plug elements 142 having different flow characteristics. For instance, a first plug element 142 may have a first pressure drop, a second plug element 142 may have a second pressure drop greater than the first pressure drop, and a third plug element 142 may have a third pressure drop greater than the second drop. The changes in pressure drop can be controlled by, for example, varying the characteristics of the porous material or the length of the plug element 142. It should be appreciated that an in-flow control device that can vary the number and/or characteristics of the plug elements 142 can be configured or re-configured at a well site to provide the pressure differential and back pressure to achieve the desired flow and drainage characteristics for a given reservoir.

It should also be understood that plug elements 142 are merely illustrative of the structures that may be used to interpose a permeable medium into a flow from a formation into a wellbore tubular. For instance, the housing may include a flow passage for receiving one or more serially aligned porous disks. The pressure drop may be controlled by varying the number of disks and/or the permeability of the disks. In another variant, the housing may include a flow cavity that can be filled or packed with elements such as spherical members. The pressure drop may be control by varying the diameter of the spherical members. In still other variants, two or more media may be used. For example, such a medium may include a combination of capillary tubes, granular elements, and/or sponge-like material.

Further, it should be understood that FIGS. 1 and 2 are intended to be merely illustrative of the production systems in which the teachings of the present disclosure may be applied. For example, in certain production systems, the wellbores 10, 11 may utilize only a casing or liner to convey production fluids to the surface. The teachings of the present disclosure may be applied to control the flow into those and other wellbore tubulars.

For the sake of clarity and brevity, descriptions of most threaded connections between tubular elements, elastomeric seals, such as o-rings, and other well-understood techniques are omitted in the above description. Further, terms such as "valve" are used in their broadest meaning and are not limited to any particular type or configuration. The foregoing description is directed to particular embodiments of the present disclosure for the purpose of illustration and explanation. It will be apparent, however, to one skilled in the art that many modifications and changes to the embodiment set forth above are possible without departing from the scope of the disclosure.

What is claimed is:

1. An apparatus for controlling a flow of fluid from a formation into a wellbore tubular, comprising:

a filtration element configured to filter particles in a fluid flowing from the formation; and a flow space positioned downstream of the filtration element, the flow space having a plurality of parallel flow paths; and a permeable medium positioned in at least one flow path of the plurality of parallel flow paths, the permeable medium including a plurality of substantially separate elements.

2. The apparatus of claim 1 further comprising a housing positioned along the wellbore tubular, the flow space being formed in the housing.

3. The apparatus of claim 2 further comprising an occlusion body in the flow space, the occlusion body being configured to disintegrate upon exposure to a preset condition.

4. The apparatus of claim 2 further comprising a plug member associated with the housing.

5. The apparatus of claim 1, further comprising a flow restriction element configured to selectively restrict flow in one of the plurality of parallel flow paths.

6. The apparatus of claim 1 further comprising an array of plug elements, wherein each of the plug elements includes the permeable medium.

7. The apparatus of claim 6 wherein the array of plug elements includes a first and a second plug element, the first plug element configured to provide a pressure drop different from the second plug element.

8. The apparatus of claim 1 further comprising a housing having a plurality of receptacles, each of the plurality of receptacles being configured to receive a plug element, each plug element including the permeable medium positioned therein.

9. A system for controlling a flow of a fluid from a formation into a wellbore tubular, comprising:

(a) a plurality of in-flow control devices positioned along a section of the wellbore tubular, each in-flow control device including:

a particulate control device having a filtration element configured to filter particles in a fluid flowing from the formation; and a housing positioned downstream of the particulate control device, the housing including: a permeable medium including a plurality of substantially separate elements positioned in at least one of a plurality of parallel flow paths between the filtration element and a flow bore of the wellbore tubular to control a flow characteristic.

10. The system of claim 9 wherein the flow characteristic is one of: (i) pressure, (ii) flow rate, and (iii) fluid composition.

11. The system of claim 9 wherein the porosity of each permeable medium is configured to cause a substantially uniform flow characteristic along the section of the wellbore tubular.

12. The system of claim 9 wherein each in-flow control device further includes an array of plug elements, wherein each of the plug elements includes the permeable medium.

13. The system of claim 12 wherein the array of plug elements includes a first and a second plug element, the first plug element configured to provide a pressure drop different from the second plug element.

14. The system of claim 9 wherein each in-flow control device further includes a housing having a plurality of receptacles, each of the plurality of receptacles being configured to receive a plug element, each plug element including the permeable medium positioned therein.

15. A method for controlling a flow of fluid from a formation into a wellbore tubular, comprising:

filtering a formation fluid using a particulate control device;

positioning a housing downstream of the particulate control device, the housing including a flow space having a plurality of flow paths receiving the filtered formation fluid and a permeable medium in at least one flow path of the plurality of flow paths, the permeable medium including a plurality of substantially separate elements; and conveying the filtered fluid to a bore of the wellbore tubular via the flow space.

16. The method of claim 15 further comprising positioning an occlusion body in the flow space, the occlusion body being configured to disintegrate upon exposure to a preset condition.

17. The method of claim 15 wherein the flow space is formed in a plug member associated with the housing.

18. The method of claim 15 further forming the flow space in an array of plug elements, and positioning the permeable medium in each of the plug elements.

19. The method of claim 18 wherein the array of plug elements includes a first and a second plug element, and further comprising configuring the first plug element to provide a pressure drop different from the second plug element.

20. The method of claim 15 further forming a housing to have a plurality of receptacles; configuring each of the plurality of receptacles to receive a plug element; forming the flow space in each plug element; and positioning the permeable medium in the flow space of each plug element.

* * * * *